United States Patent [19]

Anselmo et al.

[11] 4,381,134

[45] Apr. 26, 1983

[54] ELECTRICAL CONNECTOR FOR PLATED-THROUGH HOLES

[75] Inventors: Donald R. Anselmo, Glen Ellyn, Ill.; Thomas G. Grau, Mendham Township, Morris County, N.J.

[73] Assignee: Bell Telephone Laboratories, Incorporated, Murray Hill, N.J.

[21] Appl. No.: 243,439

[22] Filed: Mar. 13, 1981

[51] Int. Cl.[3] ..... H01R 4/10

[52] U.S. Cl. ..... 339/220 R

[58] Field of Search ..... 339/17 C, 95 R, 220 R, 339/220 T, 221 R, 221 M

[56] References Cited

U.S. PATENT DOCUMENTS

| | | | |
|---|---|---|---|
| 3,223,960 | 12/1965 | Ruehlemann . | |
| 3,248,684 | 4/1966 | Hubbard et al. | 339/95 R |
| 3,659,245 | 4/1972 | Payne | 339/220 R X |
| 3,670,294 | 6/1972 | Johnson et al. | 339/221 M X |
| 3,783,433 | 1/1974 | Kurtz et al. | 339/17 C |
| 3,825,876 | 7/1974 | Damon et al. | 339/17 CF |
| 3,846,741 | 11/1974 | Kunkle | 339/221 R |
| 3,871,728 | 3/1975 | Goodman | 339/17 C X |
| 4,017,143 | 4/1977 | Knowles | 339/221 R |
| 4,076,356 | 2/1978 | Tamburro | 339/221 R |
| 4,077,694 | 3/1978 | Lobaugh et al. | 339/17 C X |

FOREIGN PATENT DOCUMENTS

| | | | |
|---|---|---|---|
| 977871 | 11/1975 | Canada | 339/17 C |

*Primary Examiner*—Howard N. Goldberg
*Attorney, Agent, or Firm*—J. W. Fisher

[57] ABSTRACT

An electrical connector (20) adapted for engagement with a plated-through hole (13) in a printed circuit board (10) is disclosed. This connector includes first and second generally squared-shaped posts (21,22) for receiving electrically conductive elements. Intermediate these first and second posts is a compliant section (23,24,25,26) for producing an interference coupling between the connector and the plated-through hole. Juxtaposed the compliant section and intermediate and located between it and the first post is a broaching section (30) for conditioning the plated-through hole prior to engagement of the compliant section with the plated-through hole.

9 Claims, 4 Drawing Figures

ELECTRICAL CONNECTOR FOR PLATED-THROUGH HOLES

BACKGROUND OF THE INVENTION

1. Technical Field of the Invention

This invention relates to electrical connectors and, in particular, to an interference fit contact pin having a conditioning section for preparing various sized plated-through holes to receive the contact pin compliant section.

2. Description of the Prior Art

In many circuit applications there is a need to interconnect conductors and components to conductive paths either within or on a printed circuit board. Relatively recent developments to satisfy this need have centered around interconnection pins which are inserted into plated-through holes in the circuit board and held there by frictional engagement of the pin with the hole periphery.

One illustration of a frictional fit pin of this type is disclosed in U.S. Pat. No. 3,223,960 issued to H. E. Ruehlemann on Dec. 14, 1965. Ruehlemann relates to a contact with waveshaped tail sections. The contact is comprised of a body section, a mating section and a tail section projecting from the body section. The tail section includes a substantially uniplanar root which has a pair of edges extending to the body section. Extending away from at least one of the edges is an integral locking wing.

Another example of a connector of the type under consideration is set forth in U.S. Pat. No. 3,783,433 issued to H. N. Kurtz et al on Jan. 1, 1974. Kurtz et al disclose a solderless electrical connection system wherein a main mounting board is provided with a plurality of plated-through holes. A conductive electrical contact, including a central section, is pressed into the plated-through hole with the central section flexing as it is urged into the hole and yielding to generate retention forces without destroying the hole. Each end of the conductive contact is provided with a configuration which allows electrical components to be mounted thereon or attached thereto.

A somewhat related connection system to those noted above is set forth in U.S. Pat. No. 3,825,876 issued to N. F. Damon et al on July 23, 1974. Damon et al disclose an electronic component mounting system adapted for the high density packaging of integrated circuits. Each integrated circuit component is rigidly attached to a complementary cartridge of insulative material. The assembled structure is inserted in either normal or inverted position within terminals correspondingly arrayed on a mounting panel. In the normal position the assembly may be plugged in and snapped out as required, while in the inverted position the individual leads of the integrated circuit may be soldered to respective terminals. Each of the mounting panel terminals is provided with a wirewrapping pin extension.

Still another illustration of printed circuit board connectors is disclosed in U.S. Pat. No. 3,871,728 issued to D. S. Goodman on Mar. 18, 1975. Goodman relates to a matched impedance printed circuit board connector which is comprised of a housing mounted on a mounting board having a ground plane and signal traces separated by an insulator. A grounding bus extends lengthwise in the housing below the printed circuit board receiving slot. Signal contacts in the housing are mounted in plated-through holes in the mounting board which contacts are connected to the signal traces. The grounding bus has mounting portions which are mounted in other plated-through holes in the board and which are joined to the ground plane. Ground contacts are also provided in the housing which are mounted in additional plated-through holes joined to the ground plane so that the ground contacts and grounding bus are electrically interconnected.

A further example of printed circuit board connectors of the type under discussion is disclosed in U.S. Pat. No. 4,017,143 issued to R. G. Knowles on Apr. 12, 1977. Knowles relates to a solderless electrical contact which has first and second ends for connection to conductive elements. These ends are joined by a central section having a C-shaped cross section with opposing arms tapered to a reduced end thickness for press-fit mounting into a printed circuit board aperture. The tapering arms of the C-shaped cross section provide uniformly stressed beams that allow the radii of each arm to conform to tolerance variations of the aperture.

Still another illustration of an interference-fit printed circuit board connector is set forth in U.S. Pat. No. 4,076,356 issued to P. J. Tamburro on Feb. 28, 1978. Tamburro discloses an interconnection pin for connecting multiple conductive layers in a printed circuit board to one another. The connector includes a pair of elongated electrical terminals and a compliant section therebetween. A plurality of generally parallel raised pressure ridges are included on an outer surface of the compliant section. The connector may be advantageously divided into a plurality of semiseparate segments thereby enabling interconnection of an axially aligned stack of printed circuit boards.

Yet another example of circuit board connectors is disclosed in U.S. Pat. No. 4,077,694 issued to R. F. Cobaugh et al on Mar. 7, 1978. Cobaugh et al disclose a connector having a plurality of pairs of contacts arranged in a row and with each contact having a C-shaped portion. Each pair of contacts is mounted securely at first ends in a circuit board with the backs, or closed sides, of the C-shaped portion facing each other and designed to receive the edge of a second circuit board inserted therebetween.

Each of the connectors described above has the disadvantage of not being capable of preconditioning the plated-through hole prior to engagement of the interference-fit section of the connector with the hole periphery. In most instances this deficiency results from a relatively smooth or tapered transition section between the compliant portion of the connector and its terminal end. Heretofore such a smooth or tapered transition section has been a design goal since it was generally believed that any other design might give rise to damage of the plated-through hole. Hence, one of the problems experienced with interference-fit connectors has been and continues to be the proper preconditioning of the plated-through hole so that maximum retention forces can be achieved.

Another problem experienced with interference-fit connectors is their inability to remove any insulative oxide layers which may coat the inner periphery of the plated-through hole. Such layers can cause a degradation in the quality of the electrical contact between the plated-through hole and the compliant section.

SUMMARY OF THE INVENTION

The heretofore described problems are overcome in accordance with our invention of an electrical connector adapted for engagement with a plated-through hole in an electrical circuit board. This connector is comprised of first and second means for receiving electrically conductive elements. Intermediate these first and second means are means for producing an interference coupling between the connector and the plated-through hole. Juxtaposed the producing means and intermediate the producing means and the first means are means for conditioning the plated-through hole prior to engagement of the producing means with the plated-through hole.

An advantage of our connector is that the conditioning means includes a broaching section comprised of a generally cylindrical section having one or more grooves cut therein around the circumference of the cylindrical section. These grooves present one or more sharp edges which, when the contact pin is inserted into the plated-through hole, plough into the material coating the hole thereby sizing and conditioning the hole for proper engagement with the compliant section.

BRIEF DESCRIPTION OF THE DRAWING

The aforementioned advantage of our invention as well as other advantages will be better understood upon a consideration of the following detailed description and the appended claims taken in conjunction with the attached drawings of an illustrative embodiment in which:

DETAILED DESCRIPTION

Figure 1:
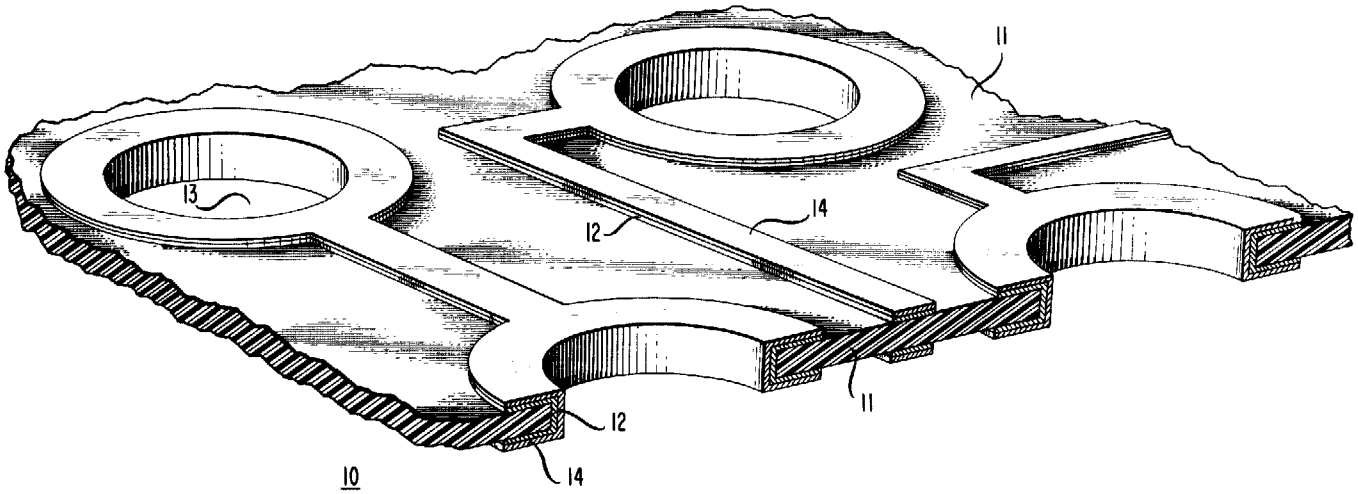
FIG. 1 illustrates a printed circuit board having conductive patterns thereon and plated-through holes therein.

Illustrated in FIG. 1 is a fairly typical printed circuit board 10. Circuit board 10 can be comprised advantageously of an epoxy-glass substrate 11 which has various conductive patterns 12 plated thereon and holes 13 therethrough. Conductive patterns 12 can have a relatively thin layer of solder 14 on their top surface. Similarly, holes 13 can have a correspondingly thin layer of solder 14 about the hole periphery.

Figure 3:
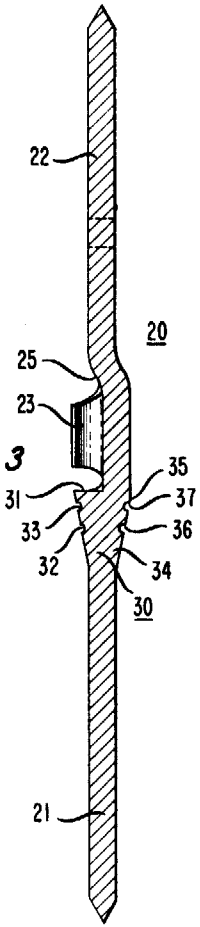
FIG. 3 is a sectional view showing the details of the broaching section.
Figure 2:
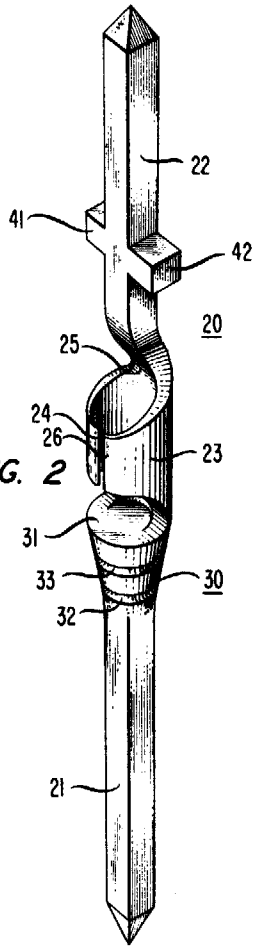
FIG. 2 is a perspective view of the subject connector having the broaching section.

Regardless of whether holes 13 have a periphery of conductive material alone or a combination of conductive material with solder over top, for our present purposes holes 13 will be referred to as plated-through holes. An electrical connector 20 which is adapted for engagement with a plated-through hole 13 in circuit board 10 is shown in FIGS. 2 and 3. Connector 20 includes first and second spaced-apart, generally square-shaped posts 21 and 22 for receiving electrically conductive elements. To facilitate this end, posts 21 and 22 are fabricated of electrically conductive material.

Intermediate posts 21 and 22 is compliant section 23 for producing an interference coupling between connector 20 and plated-through hole 13. Compliant section 23 gradually increases in cross-sectional thickness from first end point 24 to midpoint 25 and thereafter gradually decreases in cross-sectional thickness to second end point 26. This gradual increase in cross-sectional thickness from first and second end points 24 and 26, respectively, to midpoint 25 produces a nearly uniform radial pressure on plated-through hole 13 when complaint section 23 is inserted therein.

Figure 4:
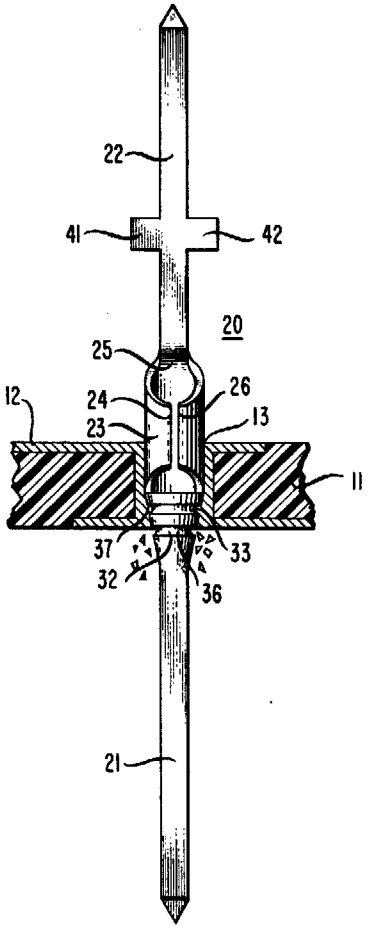
FIG. 4 illustrates the effect of the broaching section in conditioning a plated-through hole upon insertion of the connector therein.

Juxtaposed compliant section 23 and intermediate first post 21 and compliant section 23 is conditioning means 30. Conditioning means 30, which comprises a broaching section, provides a conditioning of a plated-through hole 13, as shown in FIG. 4, prior to engagement of compliant section 23 therewith. This conditioning is accomplished by ploughing out a portion of the inner surface of plated-through hole 13. By virtue of this conditioning, plated-through hole 13 is properly sized for engagement with compliant section 23. Also, any oxides or other contaminants on the inner periphery of plated-through hole 13 are removed prior to engagement with compliant section 23. This insures a reliable electrical connection between plated-through hole 13 and compliant section 23.

To accomplish these ends, the broaching section is comprised of a generally cylindrical segment 31 and at least one circumferential groove 32 extending around the periphery of segment 31. In the preferred embodiment two such grooves 32 and 33 are employed. Cylindrical segment 31 has a first diameter in region 34, shown most clearly in FIG. 3, juxtaposed first post 21 and a second diameter in region 35 juxtaposed compliant section 23. The second diameter is greater than the first diameter.

Groove 32 or, as indicated previously for the preferred embodiment, grooves 32 and 33 extend completely around the periphery of cylindrical segment 31. The groove or grooves are positioned so as to be intermediate first diameter region 34 and second diameter region 35. Each of grooves 32 and 33 is formed so as to produce at least one sharp circumferential edge about the periphery of cylindrical segment 31.

In the case of the preferred embodiment, grooves 32 and 33 each have a sharp edge. Edge 36, associated with groove 32, defines a circle having a third diameter and edge 37, associated with groove 33, defines a circle having a fourth diameter. These third and fourth diameters are greater than the first diameter of region 34 but are less than the second diameter of region 35. Moreover, the fourth diameter associated with groove 33 is greater than the third diameter associated with groove 32. By virtue of this positioning and sizing of grooves 32 and 33, plated-through hole 13 is properly conditioned for engagement with compliant section 23 upon the insertion of connector 20 into plated-through hole 13.

In order to facilitate the insertion of connector 20 into plated-through hole 13, post 22 is provided with a pair of oppositely directed tabs 41 and 42. These tabs 41 and 42 are located at an intermediate position along the length of post 22.

It should be noted also that the vertical axes of symmetry of posts 21 and 22, compliant section 23 and conditioning means 30 are in vertical alignment.

In all cases, it is to be understood that the above-identified embodiments are illustrative of but a small number of many possible specific embodiments which can represent applications of the principles of the invention. Thus, numerous and various other embodiments can be devised readily in accordance with these principles by those skilled in the art without departing from the spirit and scope of the invention.

What is claimed is:

1. An electrical connector (20) adapted for engagement with an inner surface of a plated-through hole (13) in an electrical circuit board (10) comprising:

first and second means (21,22) for receiving electrically conductive elements;

means (23,24,25,26), intermediate said first and second means, for providing an interference coupling between said connector and said plated-through hole characterized in that said connector further includes means (30), juxtaposed said interference coupling means and intermediate said first means and said interference coupling means, for conditioning a particular portion of the inner surface of said plated-through hole prior to engagement of said interference coupling means with the same particular portion of the inner surface of said plated-through hole.

2. The electrical connector (20) in accordance with claim 1 wherein said conditioning means (30) comprises a broaching section (31,32,33,34,35,36,37) having a cylindrical broaching element.

3. The electrical connector (20) in accordance with claim 2 wherein said broaching section (31,32,33,34,35,36,37) includes:

a generally cylindrical segment (31) having a first diameter in a region (34) juxtaposed said first means (21) and a second diameter in a region (35) juxtaposed said producing means (23,24,25,26), said second diameter being greater than said first diameter; and at least one circumferential groove (32 or 33) extending completely around the periphery of said cylindrical segment (31), said groove being positioned intermediate said first diameter region (34) and said second diameter region (35) and being formed so as to produce at least one sharp, circumferential edge (36 or 37) about the periphery of said cylindrical segment.

4. The electrical connector (20) in accordance with claim 2 wherein said broaching section (31,32,33,34,35,36,37) includes:

a generally cylindrical segment (31) having a first diameter in a region (34) juxtaposed said first means (21) and a second diameter in a region (35) juxtaposed said producing means (23,24,25,26), said second diameter being greater than said first diameter; and first and second spaced-apart circumferential grooves (32,33) extending completely around the periphery of said cylindrical segment (31), said grooves being positioned intermediate said first diameter region (34) and said second diameter region (35) and being formed so as to produce first and second spaced-apart, sharp, circumferential edges (36,37) about the periphery of said cylindrical segment, said first edge (36) defining a circle having a third diameter and said second edge (37) defining a circle having a fourth diameter, said third and fourth diameters being greater than said first diameter but less than said second diameter and said fourth diameter being greater than said third diameter.

5. An electrical connector (20) adapted for engagement with an inner surface of a plated-through hole (13) in an electrical circuit board (10) comprising:

first and second spaced-apart generally square-shaped posts (21,22) for receiving electrically conductive elements;

a compliant section (23) intermediate said first and second posts for providing an interference coupling between said connector and said plated-through hole, said compliant section gradually increasing in cross-sectional thickness from a first end point (24) to a midpoint (25) and thereafter gradually decreasing in cross-sectional thickness from said midpoint to a second end point (26) so as to produce a nearly uniform radial pressure on said plated-through hole upon insertion of said connector therein characterized in that said connector (20) further includes means (30), juxtaposed but separate from said compliant section (23) and intermediate said first post (21) and said compliant section, for conditioning substantially all of the inner surface of said plated-through hole (13) prior to engagement of said compliant section with said plated-through hole.

6. The electrical connector (20) in accordance with claim 5 wherein said conditioning means (30) comprises a broaching section (31,32,33,34,35,36,37) having a cylindrical broaching element.

7. The electrical connector (20) in accordance with claim 6 wherein said broaching section (31,32,33,34,35,36,37) includes:

a generally cylindrical segment (31) having a first diameter in a region (34) juxtaposed said first post (21) and a second diameter in a region (35) juxtaposed said compliant section (23), said second diameter being greater than said first diameter; and at least one circumferential groove (32 or 33) extending completely around the periphery of said cylindrical segment (31), said groove being positioned intermediate said first diameter region (34) and said second diameter region (35) and being formed so as to produce at least one sharp circumferential edge (36 or 37) about the periphery of said cylindrical segment.

8. The electrical connector (20) in accordance with claim 6 wherein said broaching section (31,32,33,34,35,36,37) includes:

a generally cylindrical segment (31) having a first diameter in a region (34) juxtaposed said first post (21) and a second diameter in a region (35) juxtaposed said compliant section (23), said second diameter being greater than said first diameter; and first and second spaced-apart circumferential grooves (32,33) extending completely around the periphery of said cylindrical segment (31), said grooves being positioned intermediate said first diameter region (34) and said second diameter region (35) and being formed so as to produce first and second spaced-apart, sharp circumferential edges (36,37) about the periphery of said cylindrical segment, said first edge (36) defining a circle having a third diameter and said second edge (37) defining a circle having a fourth diameter, said third and fourth diameters being greater than said first diameter but less than said second diameter and said fourth diameter being greater than said third diameter.

9. An electrical connector (20) adapted for engagement with an inner surface of a plated-through hole (13) in an electrical circuit board (10) comprising:

first and second spaced-apart generally square-shaped posts (21,22) for receiving electrically conductive elements;

a compliant section (23) intermediate said first and second posts for producing an interference coupling between said connector and said plated-through hole, said compliant section gradually increasing in cross-sectional thickness from a first end point (24) to a midpoint (25) and thereafter gradually decreasing in cross-sectional thickness from said midpoint to a second end point (26) so as to produce a nearly uniform radial pressure on said plated-through hole upon insertion of said connector therein characterized in that said connector (20) further includes a broaching section (31,32,33,34,35,36,37) juxtaposed said compliant section and intermediate said first post (21) and said compliant section (23) for ploughing out substantially all of the inner surface of said plated-through hole (13) prior to engagement of said compliant section with the inner surface of said plated-through hole.

* * * * *